United States Patent [19]

Duncan

[11] Patent Number: 4,727,907

[45] Date of Patent: Mar. 1, 1988

[54] TURBULATOR WITH INTEGRAL FLOW DEFLECTOR TABS

[75] Inventor: Donald C. Duncan, Pomona, Calif.

[73] Assignee: Dunham-Bush, Riverside, Calif.

[21] Appl. No.: 31,725

[22] Filed: Mar. 30, 1987

[51] Int. Cl.[4] ..... F15D 1/02; F28F 13/12

[52] U.S. Cl. ..... 138/38; 165/109.1; 165/174

[58] Field of Search ..... 138/37, 38, 39, 40, 138/42; 165/109.1, 174, 109 T, 177, 179; 366/336, 337

[56] References Cited

U.S. PATENT DOCUMENTS

| | | | |
|---|---|---|---|
| 1,056,373 | 3/1913 | Segelken | 138/38 |
| 1,058,896 | 4/1913 | Parsons et al. | 138/38 |
| 1,242,473 | 10/1917 | Prentice | 138/38 |
| 1,318,210 | 10/1919 | Boiteaux | 138/38 |
| 3,632,090 | 1/1972 | White | 138/38 X |

*Primary Examiner*—James E. Bryant, III

*Attorney, Agent, or Firm*—Sughrue, Mion, Zinn, Macpeak, and Seas

[57] ABSTRACT

A turbulator for insertion in a heat exchange pipe in the form of a flattened hollow cylindrical metal tube with adjacent flats offset by 90° and separated by integral tubular transition portions of generally triangular plane configuration. An elongated tab is partially struck out of each flat forming a fluid passage hole leading from one side of the turbulator to the other side.

7 Claims, 2 Drawing Figures

TURBULATOR WITH INTEGRAL FLOW DEFLECTOR TABS

FIELD OF THE INVENTION

This invention relates to turbulators for insertion inside of heat exchanger pipes or conduits and more particularly to an improved turbulator with integral flow deflector tabs.

BACKGROUND OF THE INVENTION

Turbulators formed of heat conductive metal have been incorporated interiorly within tubular pipes or conduits to facilitate heat exchange between the fluid flowing internally within the pipe or conduit and a further fluid external of that pipe or conduit.

Such turbulators are evidenced by U.S. Pat. Nos. 1,056,373, 2,161,887, 2,591,398, 4,106,558,. 4,179,222, 4,296,779, 4,577,681, and by French Pat. Nos. 964,415 and 1,501,967 and British Pat. No. 398,154.

Turbulators have been formed of strip metal. cylindrical metal tubes, or the like which have been given bends, or flats at longitudinally spaced positions and such turbulators may include partially struck out portions which project into the flow stream and which tend to magnify the turbulence of the fluid flowing under pressure through the interior of the conduit or pipe to thereby enhance heat transfer between the fluid passing through the conduit or pipe, and the exterior surface of the conduit or pipe which is in physical contact with a second fluid.

U.S. Pat. No. 1,056,373, for instance has a elongated metal strip of a width slightly narrower than the internal diameter of the external pipe or conduit through which the turbulator strip extends. The strip is twisted about its axis. Further, tabs or elongated fingers are partially struck out of the strip at periodic longitudinally spaced positions along the length of the twisted metal strip.

In U.S. Pat. No. 2,161,887, partially struck out tabs are at the apices of a folded metal strip which extends in serpentine fashion through the interior of a heat exchange tube. The tabs tend to deflect the fluid passing through the interior of the tube against the exterior wall.

U.S. Pat. No. 4,106,558 further evidences the partial strike out of a piece of a sheet metal strip, forming a deflector tab for the fluid passing through the tube bearing such turbulator.

French Pat. No. 1,501,967 shows a turbulator within an outer cylindrical pipe or conduit, the turbulator being formed of a tube which is flattened to provide flats at circumferentially alternating positions and with longitudinally adjacent flats being at right angles to each other.

French Pat. No. 964,415 shows a turbulator formed by first taking a strip of material folding it in half, crimping it at certain longitudinal locations to form bulbous portions which taper and then twisting the strip 180°, between the bulbous portions.

British Pat. No. 398,154 teaches near flattening of a tube and the formation of triangular shaped transition or connecting portions for the narrowed segments of the tube defined by the flattening process.

The balance of the patents not discussed specifically within the group listed above, teach the adjoining of multiple strips of metal into an assembly which extend the length of pipe and which assembly is positioned interiorly thereof to effect a transition in the movement of fluid longitudinally within the pipe and to effect a turbulence to the fluid flowing therein thereby tending to enhance heat exchange between the fluid internally of the pipe and one externally.

While such turbulators have functioned adequately, even minor improvements in heat exchange efficiency of the heat exchangers employing turbulators amount to a significant improvement where there is little margin for error in achieving the desired heat exchange between a fluid captured internally within the heat exchange conduit and a second fluid external thereto.

This is particularly true in the area of oil coolers for diesel engine driven trucks and the like where, the ability of the engine oil to effectively lubricate the moving parts of an internal combustion engine is delatoriously affected by the operating temperature of the engine.

The improved turbulator of the present invention is particularly useful within such oil cooler heat exchanger in which the oil flows under pressure through a cylindrical metal pipe or conduit, and is cooled by an ambient air stream flowing over the external surface of the conduit.

SUMMARY OF THE INVENTION

The present invention is directed to an improved turbulator unit for insertion in a heat exchanger pipe having a substantially straight longitudinal internal wall. The turbulator may comprise a cylindrical metal tube having a series of flattend wall portions at longitudinally spaced positions along said tube, forming flats with adjacent flattend portions being offset circumferentially by 90° and being connected together by hollow tubular transition portions which are generally triangular shaped in plan configuration. An elongated tab is partially struck out of each flattend wall portion at an acute angle to the plane of the flattend wall portion and defines a fluid passage hole within the flattend wall portion.

The succeeding, inline co-planer flats have tabs projecting obliquely to opposite sides of said tube. The tabs point in the same direction. The tabs may have side edges which taper toward each other in the direction of the free end of the tab. The length of the flattend wall portions may be in excess of the length of each hollow transition portion joining adjacent flattend wall portions.

DESCRIPTION OF THE PREFERRED EMBODIMENT

Figure 1:
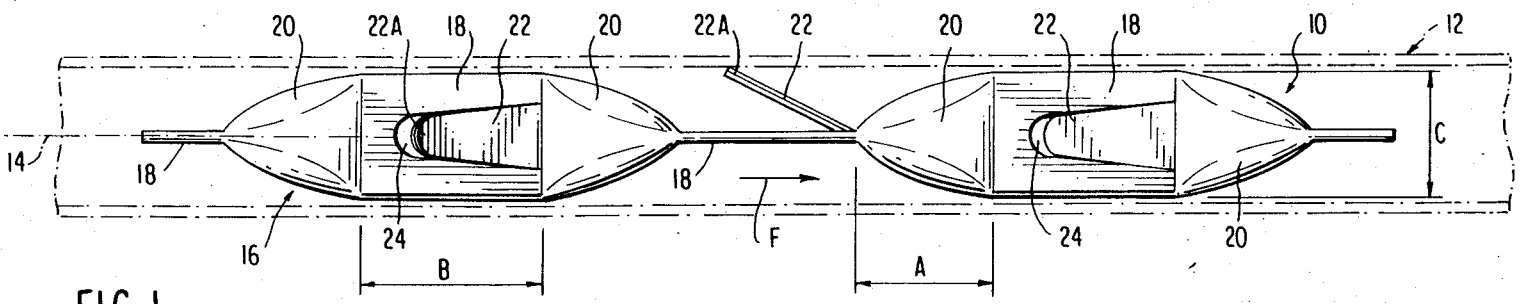
FIG. 1 is a side elevational view of the improved turbulator forming a preferred embodiment of the present invention.
Figure 2:
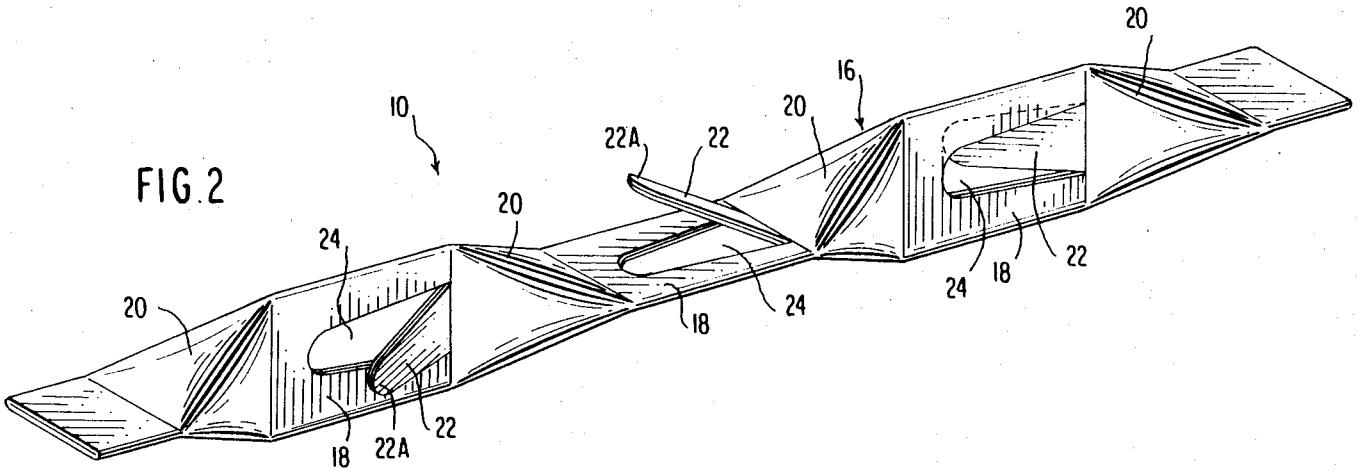
FIG. 2 is a perspective view of the turbulator of FIG. 1.

Referring to FIGS. 1 and 2, a turbulator indicated generally at 10, which is axially insertable within a cylindrical conduit or a pipe indicating generally at 12 and shown in phantom line form, has a diameter C which is slightly less than the internal diameter of the pipe 12, within which the turbulator 10 is positioned. The axis 14 of the turbulator 10 is coincident with the axis of the conduit 12. The turbulator 10 is formed of a unitary metal tube 16 which may be formed of a heat conductive metal such as aluminum. The tube 16 is periodically flattened at longitudinally spaced positions to form segmental flats 18 separated by tubular transition portions 20 which are generally of triangular plan configuration. The tubular transition portions 20 are hollow and make the transition from one flat 18 to the adjacent flat 18. The succeeding flats 18 are at right angles to one another, thus, the alternate flats 18 are co-planer. In compressing the tube to form the flats 18, the opposed walls of the tube are moved into contact with each other closing off the tube interior of the flats 19. The creation of the flats 18 which may be effected by a metal stamping process is such that the transition portions 20 of the tube are hollow and bulbous. i.e., essentially three dimensional while the flats take on the aspect of a two dimensional, planer form.

Keyed to the improved heat exchange capability of the turbulator is the presence of a single tab 22, partially struck out, of each flat 18 and which tab 22 is bent to an oblique, acute angle with respect to the plane of the flat 18 from which it emanates. In partially striking out tab 22, a arcuate tip or free end 22A is formed. The act of striking out the tab 22 creates a similarly shaped opening 24 with each flat 18 which extends through the flat 18 at each location. It should be noted, that the tabs 22 all have their free ends or tips 22A pointing in the same direction.

As may be appreciated, the length of a transition portion 20 of the tube 16 may have a dimension A which is equal to or less than the length of the adjacent flat B further, the length of the tab 22 may be less than the length B of the flat from which it is partially struck out. When a fluid such as a liquid or a gas circulates through the conduit or pipe 12 in the direction of the arrow F, it passes over the external surface of the turbulator 10, impinges against the oblique tab 22 at each flat 18 and is deflected through the hole 24 within that flat, to the opposite side of the flat. As illustrated, the free end or lip 22A of each tab, projects beyond the outside of the lateral width of the turbulator proper and indeed, may be compressed slightly in the direction of the flat from which it emanates, during insertion of the turbulator within the pipe 12. Insertion of the turbulator 10 within pipe 12 should therefore be made in the flow direction F, FIG. 1.

As may be appreciated, this type of turbulator remedies inherent defects in oil cooling heat exchanger to prevent the surface oil from clinging to the internal wall of pipe 12 and to cause all of the oil passing internally of the pipe 12 to turn over and over and wipe the internal wall of the pipe 12 in a manner insuring equal temperature of the oil as it passes through the pipe 12. Thus, the inherent defect is overcome wherein the oil tends to cling to the walls of the tube 12 and travel at a greater speed at the center of the tube thereby requiring a major heat transfer through the slowly moving oil.

It will be understood that various modifications may be made without departing from the spirit and scope of the invention in other applications of the invention, including variations in the detail equivalent embodiments thereof, are intended to be embraced with the scope of the claims which follow.

What is claimed is:

1. An improved turbulator for insertion in a heat exchanger pipe having a substantially straight longitudinal internal wall, said turbulator comprising:

a cylindrical metal tube being flattened at longitudinally spaced positions along said tube to form flats offset circumferentially by 90°, and hollow tubular transition portions of said tube connecting said flats together said transition portions being of generally triangular shape in plan configuration, and an elongated tab partially struck out of each flat at an acute angle to the plane of the flat and defining a fluid passage hole within each flat leading from one side of the turbulator to the other.

2. The turbulator as claimed in claim 1 wherein, alternating flats are co-planer, and have tabs projecting obliquely to opposite sides of said tube.

3. The turbulator as claimed in claim 1 wherein said tabs have free ends pointing in the same direction.

4. The turbulator as claimed in claim 2 wherein said tabs have free ends pointing in the same direction.

5. The turbulator as claimed in claim 3 wherein said tabs have side edges which taper toward each other in the direction of the free end of the tab.

6. The turbulator as claimed in claim 1 wherein said flats are of a length which are in excess of the length of each hollow transition portion joining adjacent flats.

7. The turbulator as claimed in claim 1 wherein, said tabs are of a length, and are at an oblique angle such that the free ends of the tab extend radially beyond the diameter of the turbulator proper as defined by the width of said flats.

* * * * *